United States Patent [19]

DuBois

[11] 4,062,084

[45] Dec. 13, 1977

[54] PAINT BRUSH BRIDLE ATTACHMENT

[76] Inventor: Donald E. DuBois, Rte. 28, Ashokan, N.Y. 12481

[21] Appl. No.: 703,449

[22] Filed: July 8, 1976

[51] Int. Cl.[2] ..... A46B 9/10

[52] U.S. Cl. ..... 15/169

[58] Field of Search ..... 15/166, 168–170, 15/246, 248 R, 247

[56] References Cited

U.S. PATENT DOCUMENTS

| | | | |
|---|---|---|---|
| 483,733 | 10/1892 | Bennett | 15/169 |
| 739,230 | 9/1903 | Smith | 15/169 |
| 822,377 | 6/1906 | Lesso | 15/169 |
| 924,623 | 6/1909 | McMillan | 15/169 |

*Primary Examiner*—Daniel Blum

*Attorney, Agent, or Firm*—Robert D. Farkas

[57] ABSTRACT

A paint brush bridle attachment device is removably secured to a paint brush. The device includes a bridle section engaging the bristles of the paint brush, a retaining band engaging the head of the paint brush and an elongated band member which is removably secured to both the retaining band and bridle section.

5 Claims, 6 Drawing Figures

PAINT BRUSH BRIDLE ATTACHMENT

BACKGROUND OF THE INVENTION

A major problem existing with the weekend painter is painting a straight line along a window sash or between the juncture of a wall or ceiling or where any two differently colored sections intersect.

The present invention permits the average painter to accomplish this art.

A number of U.S. Pats. relate to bridle attachment devices for paint brushes. These Patents are: Nos. 928,699 to Reese; 927,232 to Gindorff, and 1,484,230 to Northrup.

SUMMARY OF THE INVENTION

My present invention relates to a unique and novel paint brush bridle attachment device.

An object of my present invention is to provide a paint brush bridle attachment device of simple design which prevents the spreading of the bristles of a paint brush thereby permitting the user in achieving better performance in painting a straight line.

A further object of my present invention is to provide a bridle attachment device which is readily disassembled into its component parts for ease of cleaning.

A still further object of my present invention is to provide a means for readily adjusting the height of the bridle on the bristles of the paint brush.

Briefly, my present invention comprises a bridle section engaging the bristles of the paint brush, a retaining band frictionally engaging the head of the paint brush, an elongated band member, wherein the elongated band member is removably secured to both the retaining band and the bristle section.

BRIEF DESCRIPTION OF THE DRAWINGS

The objects and features of the invention may be understood with reference to the following detailed description of an illustrative embodiment of the invention, taken together with the accompanying drawings in which.

DETAILED DESCRIPTION OF THE PREFERRED EMBODIMENT

Figure 1:
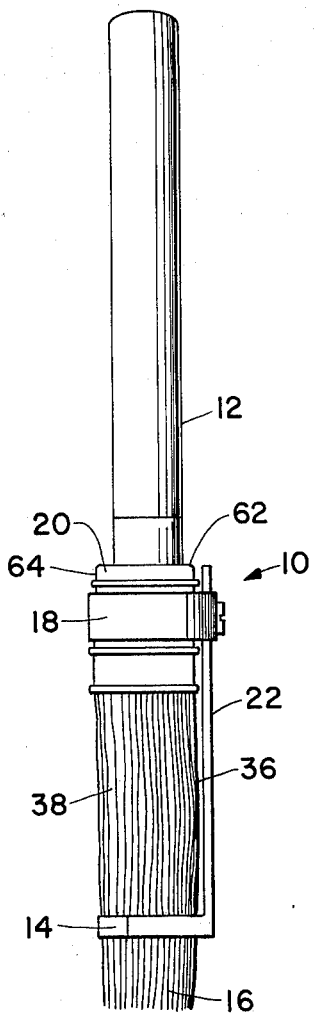
FIG. 1 illustrates a side view of a paint brush bridle attachment device removably mounted on a paint brush.
Figure 2:
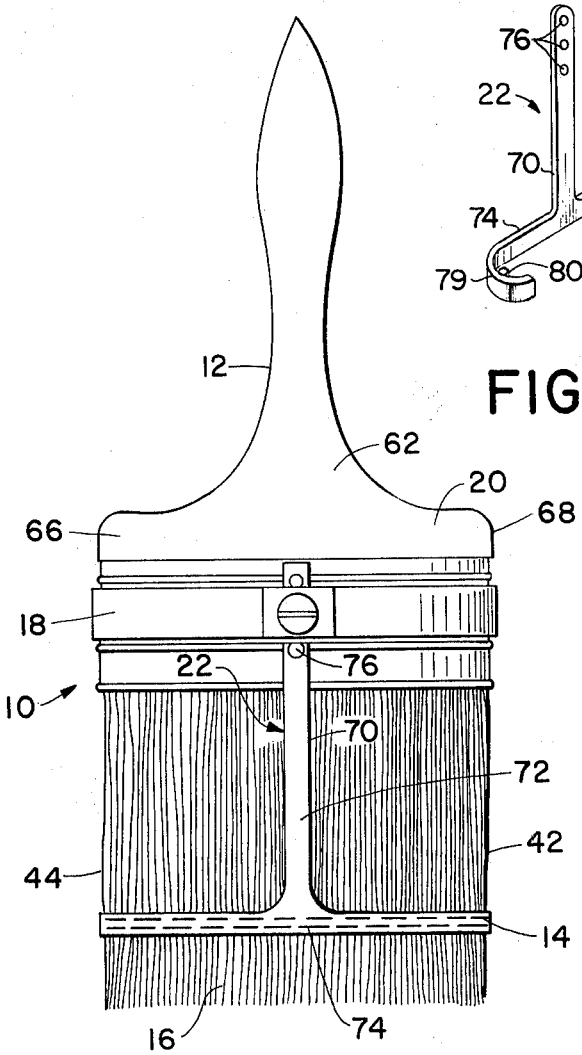
FIG. 2 illustrates a front view of the device mounted on the paint brush.

Turning now descriptively to the drawings, in which similar reference characters denote similar elements throughout the several views, FIGS. 1—2 show a paint brush bridle attachment device 10 adapted to be received on paint brush 12 for improving the performance of the user in applying paint to a surface in a straight line. The device 10 generally comprises a bridle section 14 adapted to be received on the bristles 16 of the brush 12, a retaining band 18 adapted to be received on the head 20 of the brush 12 and an elongated band member 22 communicating between section 14 and band 18.

Figure 5:
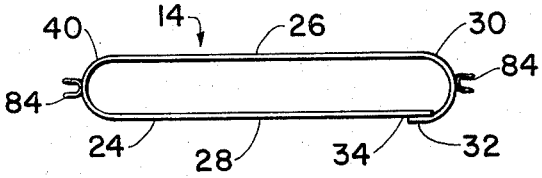
FIG. 5 illustrates a side view of the bridle section of the device in a closed position.

FIG. 5 shows the bridle section 14 which comprises a U-shaped member 24 having a pair of legs 26, 28. to the outer end of one leg 26 is integrally affixed a hook-shaped portion 30, wherein the outer end 32 of portion 30 extends inwardly over the outer end 34 of leg 28. The bridle is formed from a spring type material thereby locking ends 32, 34 together. The legs 26, 28 of the bridle section 14 engage the front 36 and rear 38 faces of the bristles 16 and the base 40 of member 24 and portion 30 engage the ends 42, 44 of the bristles.

The retaining band 18 comprises an elongated continuous band element 46 formed from a flexible type material which slips on the head 20 of the brush 12 and is retained there by frictional engagement. Element 46 includes a pair of elongated rectangularly shaped center sections 48, 50 disposed in parallel planes, wherein each set of ends of sections 48, 50 are joined integrally together by curved shaped end portions 52, 54. the center outer surface of one section 48 has a raised boss 56 thereon. The center inner surface 57 of section 48 has a channel 58 therein, wherein channel 58 extends inwardly into boss 56. The boss 56 has a center hole 60 therethrough, wherein hole 60 communicates with channel 58. The sections 48, 50 engage the sides 62, 64 of the head 20 while the portions 52, 54 engage the ends 66, 68 of the head 20.

The band member 22 comprises an inverted T-shaped element 70 having a stem 72 and a cross bar section 74. The upper end 76 of stem 72 of the inverted T-shaped element 70 has a row of aligned apertures 76 therethrough. The end 76 of stem 72 is received into channel 58. A screw means 78 extends inwardly through hole 60 and threadably engages into one of the apertures 76 thereby removably securing member 20 to band 18. Depending on which aperture 76 screw means is received into, the relative placement of cross bar section 74 with respect to the bristles 16 is adjusted. The outer ends 79, 80 are of a hook shaped configuration, wherein ends 79, 80 frictionally engage onto the outer surfaces of base 40 and portion 30 of the bridle section 14 thereby retaining section 14 in a fixed portion on the bristles 16. Band 18 can be formed from a rigid plastic material, wherein screw 78 threadably extends through hole 60 and through one of the apertures 76 in member 22 thereby bearing against the head of the brush for securing the band 18 to the head of the brush.

Figure 6:
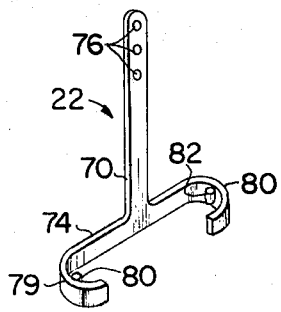
FIG. 6 illustrates an alternate embodiment of the elongated band member of the device.
Figure 3:
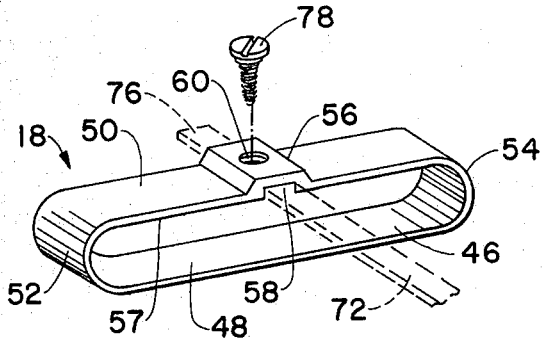
FIG. 3 illustrates a perspective view of a retaining band of the device.
Figure 4:
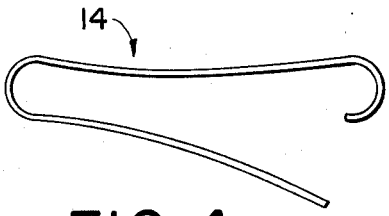
FIG. 4 illustrates a side view of a bridle section of the device in an open position.

FIG. 6 shows a second means of removably securing cross bar section 74 to the bridle section 14. A snap element 82 is affixed onto the inner surface of each hook-shaped outer end 79, 80 of section 74. A snap receiving element 84 is embedded into the outer surfaces of base 40 and portion 30 of section 14, wherein each element 84 removably receives one of the elements 82 therein.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A paint brush bridle attachment device adapted to be removably received on a paint brush, which comprises:

a. a bridle section adapted to be removably received on the bristles of said paint brush including a U-shaped element having a pair of legs joined by a base, a hook shaped portion integrally joined to an outer end of one of said legs, said hook shaped portion frictionally engaging the other of said legs;

b. a retaining band adapted to be removably received on a head of said paint brush, said retaining band including a pair of sides joined together at their ends by U-shaped portions;

c. an elongated band member, said elongated band member being a T-shaped element having a cross bar section and a stem;

d. means for removably mounting said band member on said bridle section and e. means for adjustably securing said band member to said retaining band, one said side having a raised boss thereon, an inner surface of said one side of said pair of surfaces having a slotted channel therein, said boss having a hole therethrough, said hole communicating with said channel, said stem at an outer end having a row of longitudinally aligned apertures therethrough.

2. A device according to claim 1 wherein said removably mounting means comprises said cross bar section of said T-shaped element having a pair of hooked ends.

3. A Device according to claim 1 wherein said removably mounting means further includes:

a. a plurality of snap receiving elements carried by said bridle section; and b. a plurality of snap elements mounted on said cross bar section, one said snap element received in each said snap receiving element.

4. A device according to claim 1 wherein said removably mounting means is frictional engagement of said band member with said bridle section.

5. A device according to claim 1 wherein said adjustable securing means further comprises a screw element threadably extending through said hole of said boss and through one of said apertures.

* * * * *